United States Patent [19]

Henderson

[11] Patent Number: 4,574,289

[45] Date of Patent: Mar. 4, 1986

[54] ROTARY SCAN ANTENNA

[75] Inventor: Albert S. Henderson, Melbourne, Fla.

[73] Assignee: Harris Corporation, Melbourne, Fla.

[21] Appl. No.: 499,505

[22] Filed: May 31, 1983

[51] Int. Cl.[4] ..... H01Q 13/02

[52] U.S. Cl. ..... 343/786; 343/425; 333/257

[58] Field of Search ..... 343/756, 759, 761, 783, 343/786, 425; 333/159, 256, 257

[56] References Cited

U.S. PATENT DOCUMENTS

| | | | |
|---|---|---|---|
| 2,774,067 | 12/1956 | Bollinger | 343/762 |
| 2,881,432 | 4/1959 | Hatkin | 343/756 |
| 3,010,105 | 11/1961 | Jones et al. | 343/754 |
| 3,021,524 | 2/1962 | Kompfner | 343/783 |
| 3,141,169 | 7/1964 | Bellis et al. | 343/730 |
| 3,274,603 | 9/1966 | Kay | 343/781 |
| 3,277,490 | 10/1966 | Williams | 343/792.5 |
| 3,423,756 | 1/1969 | Foldes | 343/775 |
| 3,605,100 | 9/1971 | Parad | 343/777 |
| 4,387,378 | 6/1983 | Henderson | 343/786 |

*Primary Examiner*—Eli Lieberman

*Attorney, Agent, or Firm*—Yount & Tarolli

[57] ABSTRACT

An antenna having a rotatable phase center is disclosed. The antenna includes a horn antenna having a phase center and at least one rod-like impedance element located adjacent a wall of the horn antenna near the phase center. The length of the impedance element is selected such that it shifts the phase center from its normal, undisturbed location without substantially affecting the amplitude pattern of the antenna. Means is provided for mechanically rotating the rod-like impedance element around the phase center so as to thereby cause the phase center to also rotate.

14 Claims, 6 Drawing Figures

ROTARY SCAN ANTENNA

BACKGROUND AND FIELD OF THE INVENTION

The present invention relates to an antenna having a rotating phase center. The antenna may be used, for example, as a feed for a tracking antenna.

High gain antennas often employ a compound structure including a relatively small feed and a substantially larger lens or reflector for focusing electromagnetic energy at the feed. High gain antennas specifically designed for tracking moving signal sources generally utilize special antenna feeds, known as tracking feeds, for deriving signal information to be used to control movement of the antenna in such a manner that it remains pointed at the signal source. In a conical scan antenna, the main receiving element associated with the tracking feed is located slightly off of the focal point of the associated lens or reflector, and is physically rotated around the focal point. As long as the signal source is located off the boresight of the antenna, the received signal is modulated in accordance with the rotation of the main receiving element. Tracking information can be derived directly from the received signal by determining the phase and amplitude of the modulation.

Another type of tracking feed does not utilize mechanical rotation of the receiving element. Instead, four crossed dipole elements are positioned at fixed locations around the main receiving element. The crossed dipoles are designed so that they interact only mildly with the electromagnetic wave, shifting the phase center of the feed without affecting its amplitude pattern. The extent to which the crossed dipole elements shift the phase center of the feed is dependent upon the impedances of the crossed dipole elements. The impedance states of the crossed dipoles are electronically switched so as to thereby change the location of the phase center of the main receiving element. By changing the impedance states of the four crossed dipole elements in a sequential manner, the phase center of the receiving element can be rotated around the main receiving element. This imparts the same type of modulation to the received signal as does a conical scan tracking feed.

Since the phase center is rotated electronically, the feed does not require any mechanically moving parts. Unfortunately, however, the approach cannot be readily implemented at frequencies of 60 GHz or greater. The solid-state electronic components used to switch the dipole elements themselves have impedance characteristics which vary with frequency. The impedance characteristics of the solid state elements at frequencies of 60 GHz or greater are such that they cannot readily be used to provide the impedance switching function.

SUMMARY OF THE INVENTION

It is an object of the present invention to provide a new antenna having a phase center which is rotatable.

It is another object of the present invention to provide a new antenna tracking feed.

It is yet another object of the present invention to provide a tracking feed suitable for use at frequencies of 60 GHz and greater.

It is still another object of the present invention to provide a tracking feed having a phase center which is mechanically rotatable, but which does not require that the entire tracking feed be rotated.

In accordance with the present invention, apparatus is disclosed which includes a horn antenna having a phase center and at least one rod-like impedance element located adjacent a wall of the horn antenna near the phase center. Means is provided for mechanically rotating the rod-like impedance element around the phase center so as to thereby cause the phase center of the horn antenna to also rotate.

BRIEF DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
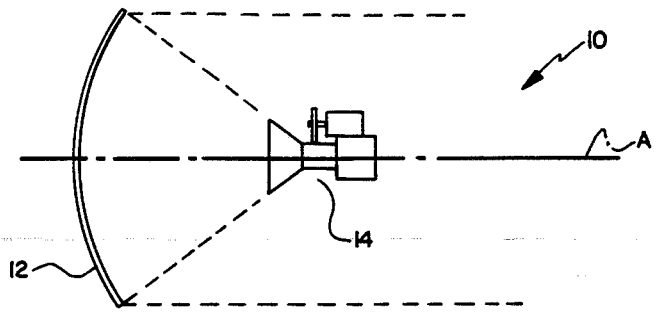
FIG. 1 is an illustration of a parabolic antenna employing the tracking feed of the present invention.

FIG. 1 illustrates a high gain directional antenna 10 including a tracking feed in accordance with the present invention. The antenna 10 includes a parabolic dish reflector 12 and a circularly polarized tracking feed 14. The tracking feed 14 is supported at the focal point of the reflector by means of support members which are not shown in the Figure. The large reflector gathers incoming electromagnetic waves and redirects them towards the tracking feed. The boresight of the antenna is represented by the axis A.

Figure 2:
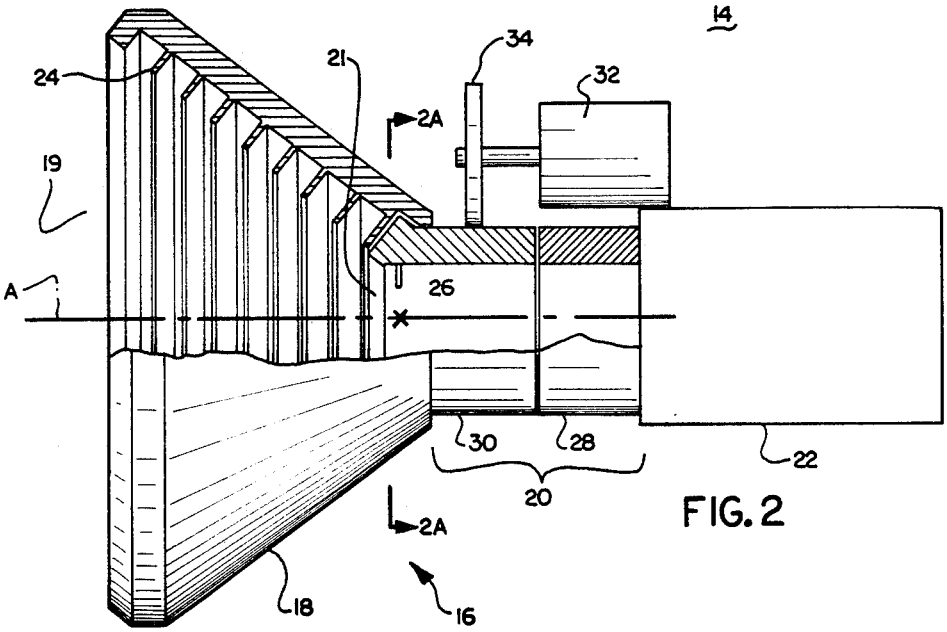
FIG. 2 is a detailed illustration, partly in section, of the tracking feed of the antenna of FIG. 1.

The construction of the tracking feed 14 is shown in greater detail in FIG. 2. As shown in FIG. 2, the tracking feed 14 is comprised of a horn antenna 16 and a receiver/transmitter 22. (The receiver/transmitter 22 is conventional; the size and shape of the block 22 are not intended to be representative of the size and shape of the actual receiver/transmitter.) The horn antenna 16 includes a flared section 18 having a mouth 19 and a throat 21. Electromagnetic waves enter the feed through the mouth of the horn, and are guided from the throat of the horn to the receiver/transmitter by the cylindrical waveguide 20. The cylindrical waveguide is connected between the throat 21 of the flared section and the receiver/transmitter 22. The flared section 18 and waveguide 20 are cylindrically symmetrical about a common axis coincident with the boresight axis A. In the embodiment illustrated in FIG. 2, the flared section 18 of the horn 16 is corrugated (that is, includes interior annular grooves). In some applications, however, it may be desirable to provide a flared section with a smooth rather than a corrugated interior surface.

The phase center of the horn antenna 16 is located within the throat 19 of the flared section 18. The focal point of the parabolic reflector 12 is located on the boresight axis A coincident with the (undisturbed) phase center of the tracking feed 14 (the normal phase center location is indicated in FIG. 2 by a small "x"). In order to develop tracking information from the tracking feed, the tracking feed of FIG. 2 includes means for shifting the phase center from its normal, undisturbed position on the axis A and causing it to rotate around the axis.

Rod-like probes are used to displace the antenna phase center from the boresight axis (A) of the feed. The probes are positioned adjacent the wall of the cylindrical waveguide at an axial location near the phase center of the feed. The probes interact with the incoming electromagnetic wave and shift the phase center off of the boresight axis of the tracking feed toward the probes without substantially affecting the amplitude pattern or directional characteristics of the antenna. In order to obtain phase center rotation, the probes are physically rotated around the phase center of the feed.

Figure 2A:
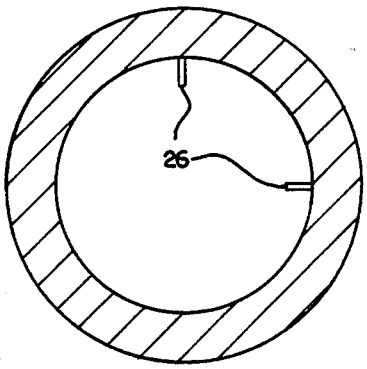
FIG. 2A is a cross sectional view of the FIG. 2 tracking feed.

In the embodiment of FIGS. 2 and 2A, the horn antenna includes two rod-like metal probes 26 (referred to occasionally hereinafter as "paracletic" probes or elements) extending radially from a side wall of the cylindrical waveguide 20 at an axial location corresponding to the axial location of the phase center of the antenna. The two probes are circumferentially separated by 90°. Each paracletic probe is electrically shorted to the side wall of the cylindrical waveguide 20, and extends in a direction substantially normal to the side wall to which it is attached.

The position of the phase center of the tracking feed is affected by the coupling between the paracletic probes and the incoming electromagnetic wave. The level of coupling depends upon the reactance of the paracletic probes: the lower the reactance, the greater the coupling between the paracletic probes and the electromagnetic wave. Each paracletic probe represents one half of a dipole element, the second half of which is represented by the image of the paracletic probe across the ground plane formed by the wall of the cylindrical waveguide. Each probe is a small cylindrical pin. The reactance of each probe is a function of the length of the probe in proportion to the wave length of the electromagnetic wave received by the feed. In the embodiment being described, a preferred level of coupling was found to occur when the paracletic probe had a length on the order of $\frac{1}{8}$ of a wave length. The paracletic probe then presented the desired nonparasitic reactance and shifted the phase center of the antenna towards the probe, without substantially affecting its directional pattern. In other applications, the number, size and spacing of the paracletic probes may be different. The best number, size, and spacing for each application will be determined experimentally.

Phase center rotation is achieved in the FIG. 2 embodiment by physically rotating the portion of the cylindrical waveguide to which the paracletic probe 26 is attached. To this end, the cylindrical waveguide 20 is formed in two sections 28 and 30, where the section 30 is free to rotate with respect to not only the section 28, but also with respect to the flared section 18. The waveguide section 30 is held in proper alignment (coaxial with the other section 28) by ball bearing races (not shown in FIG. 2). The flared section 18 is held in coaxial alignment with respect to the waveguide section 28 by braces (also not shown in FIG. 2). The wave guide section 30 is rotated by an electric motor 32. The electric motor 32 has a rubber impeller wheel 34 which resiliently engages the outer surface of the cylindrical waveguide section 30. When the electric motor is powered, it drives the waveguide section 30, causing it to rotate around its axis. Rotation of the cylindrical waveguide section 30 causes rotation of the paracletic probes 26 around the phase center of the antenna, thereby causing the phase center of the antenna to rotate in a similar circular pattern.

The use of a mechanically rotated paracletic probe section provides several advantages over past tracking feeds. First, only the section of the waveguide containing the paracletic probes need be rotated. Thus, the motor 32 necessary to produce the desired rotation can be quite small. In addition, complicated counter weight arrangements and heavy support structures are not necessary.

Figure 3:
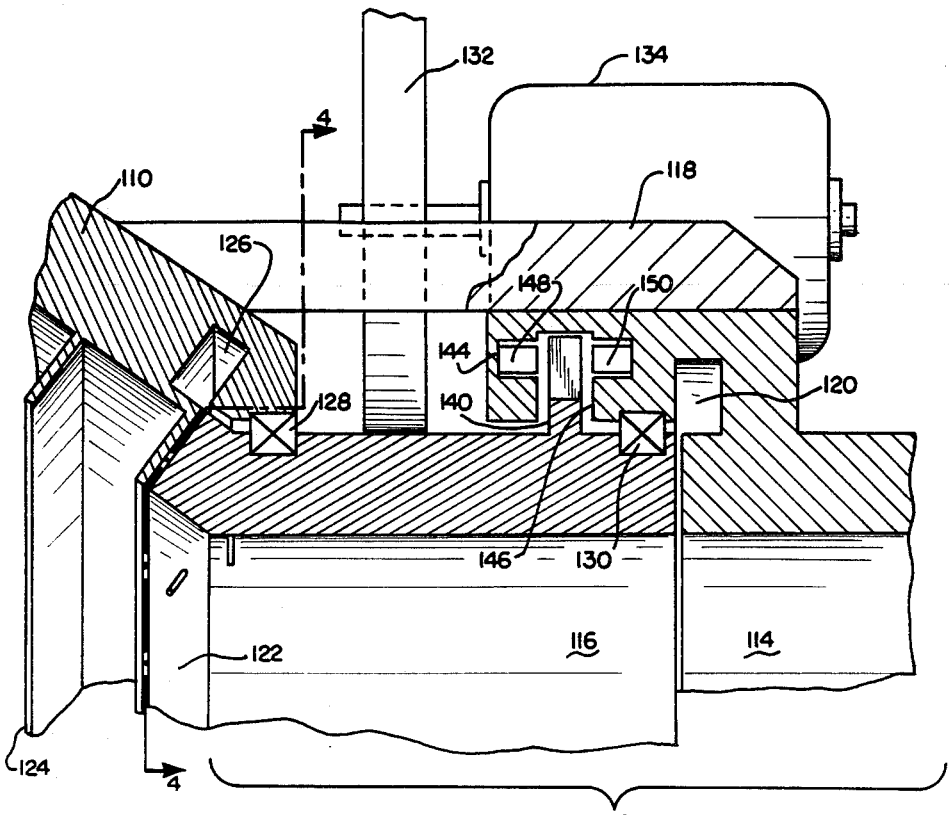
FIG. 3 is more detailed sectional view of one embodiment of a tracking feed in accordance with the teachings of the present invention.
Figure 4:
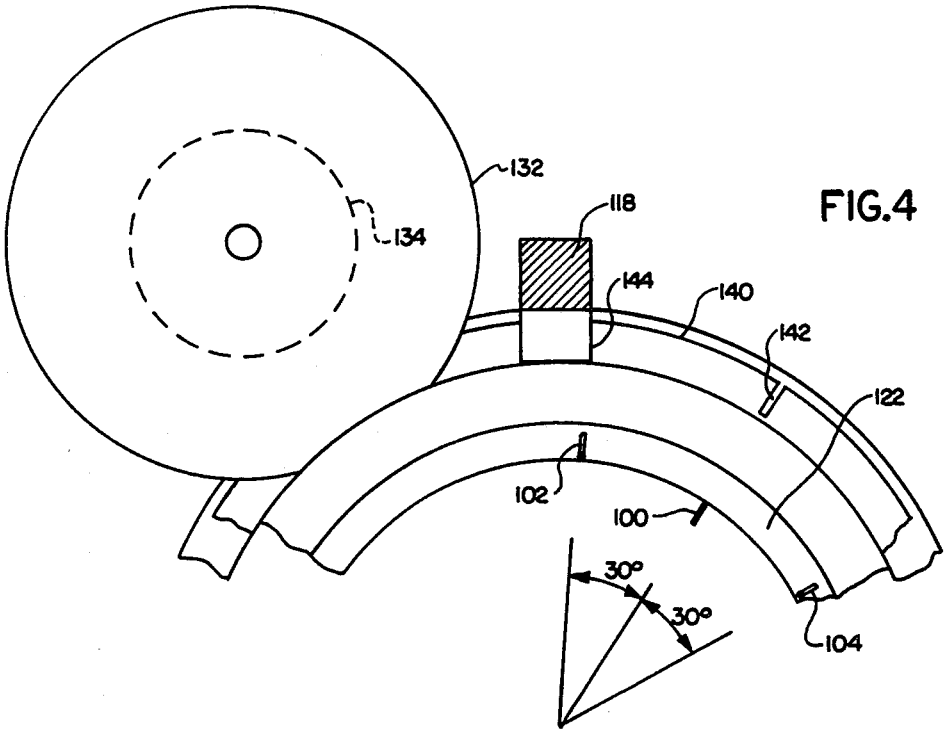
FIG. 4 is a front sectional view of a portion of the tracking feed of FIG. 3.

FIGS. 3 and 4 are more detailed cross sectional views of a tracking feed in accordance with the present invention. The horn antenna shown partially in FIG. 3 includes a flared portion 110 and a cylindrical wave guide portion 112 which includes a stationary section 114 and a rotating portion 116. Stationary cylindrical waveguide portion 114 is fixed relative to the flared portion by four braces 118 which extend axially between the portions 114 and 110 at four equally spaced circumferential locations around the horn antenna. The intermediate portion 116 of the cylindrical waveguide has an interior diameter which matches the interior diameter of the fixed waveguide section 114, whereby there is no radial step between the two portions of the cylindrical waveguide. The two portions of the waveguide are joined by a choke joint 120 of conventional construction, hence the transition appears to be shorted across insofar as an electromagnetic wave is concerned.

The intermediate cylindrical waveguide portion 116 has a lip 122 extending around the circumference of the axial end adjacent the flared portion 110. The interior surface of the lip 122 is flared outward at the same angle as the flare of the horn 110, and lies on the conical surface defined by the interior radial extremities of the corrugations 124 on the flared portion 110. The first corrugation 124 of the flared portion 110 is joined to the annular lip 122 by a choke joint 126. The intermediate cylindrical waveguide portion 116 is mounted on ball bearing races 128 and 130, carried by the flared portion 110 and the fixed cylindrical portion 114, respectively. The intermediate cylindrical waveguide portion 116 rotates within the bearing races 128 and 130 about an axis coincident with the axis of cylindrical symmetry of the cylindrical waveguide portions 114 and 116 and the flared portions 110 (i.e., the boresight axis A). Consequently, the intermediate portion 116 remain properly aligned to the other two portions 110 and 114 at all rotational positions.

The intermediate portion 116 is rotationally driven by an impeller wheel 132 which is affixed to the axle of an electric motor 134. The axle of the motor is parallel to the rotational axis of the intermediate portion 116. The motor is mounted on the fixed cylindrical portion 114 at a radial location selected so that the rubber rim of the impeller wheel resiliently engages the outer surface on the intermediate portion 116. Thus, as the motor 134 drives the impeller wheel 132, the friction engagement between the impeller wheel 132 and the intermediate cylindrical waveguide portion 116 causes the cylindrical waveguide portion 116 to rotate within the bearing races, thereby in turn rotating the phase center of the tracking feed.

In the embodiment of FIGS. 3 and 4, the paracletic elements used to move the phase center off of the axis again take the form of rod-like elements extending radially inward from the wall of the rotating portion of the cylindrical waveguide. In this embodiment, however, there are three paracletic elements rather than two as in the embodiment of FIG. 2. The first paracletic element 100 corresponds with one of the paracletic elements 26 of FIG. 2, and is positioned and oriented in substantially the same fashion as is the corresponding paracletic element 26 of FIG. 2. The remaining two paracletic elements 102 and 104, however, are situated at a different axial location. More specifically, the paracletic elements 102 and 104 are located upon, and extend normal to the conical interior surface of the annular lip 122 of the waveguide portion 116. The paracletic elements 102 and 104 are circumferentially offset from the paracletic element 100 by equal and opposite angles, shown as 30° in FIG. 4. The purpose of the paracletic elements 102 and 104 is to maximize the modulation imparted to the received signal by the feed by equalizing the affect on both linear components of the incoming circularly polarized electromagnetic wave. The optimum spacing, size, and even number of paracletic elements will again vary from one application to another, and will best be empirically determined.

Rotation of the phase center imparts an amplitude modulation to the otherwise constant amplitude signal received by the receiver-transmitter which is connected to the cylindrical waveguide 114. The phase and magnitude of the modulation are dependent upon the location of the signal source relative to the boresight (axis A) of the tracking feed. By synchronously demodulating the modulation imparted to the received signal by the tracking feed, signal source location information can be recovered.

In general, tracking error is detected by comparing the amplitude of the envelope of the received signal at one instant in time with the amplitude of the envelope at another instant when the phase center is at a diametrically opposite position across the cylindrical waveguide. If the signal source is aligned with the boresight of the tracking feed, then the electromagnetic signal will be focused upon the axis A of the cylindrical waveguide. The phase center of the feed will then be displaced from the focus of the signal by the same amount regardless of the rotational position of the intermediate cylindrical waveguide portion 116. Thus, rotation of the phase center will not affect the received signal. The received signal will then have a constant amplitude (unmodulated) envelope. When the signal source is displaced from the boresight of the tracking feed, however, the phase center will be nearer to the focus when it is on one side of the axis than when it is on the opposite side of the axis. Thus, the received signal will have an amplitude which cyclically grows larger and then smaller as the phase center move closer to and then farther from the focus of the radio energy. By comparing the amplitudes of the received signal when the paracletic probes are at two diametrically opposing positions across the axis of the cylindrical waveguide, tracking error in a given plane can be determined.

To permit determination of the location of the paracletic probes and thus of the antenna phase center by the demodulator, the intermediate cylindrical waveguide portion 116 has an annular ring 140 formed on its outer surface. The ring 140 has a notch 142 in its perimeter in circumferential alignment with the location of the paracletic probe 100. Each of the braces 118 has an optical sensor assembly 144 depending from it. Each of the sensor assemblies 144 has a transverse groove 146 for receiving the annular ring 140 of the intermediate cylindrical waveguide section 116. In addition, each sensor assembly includes a light source 148 and a light sensor 150 disposed on opposing sides of the groove 146. Normally, the path between the light source 148 and the light sensor 150 is blocked by the ring 140. When the waveguide section 116 is in a circumferential position wherein the notch 142 is aligned with the optical path between the light source 148 and light sensor 150, however, the light path is clear and light is transmitted to the detector 150 from the source 148. Each sensor provides a high level signal at its output when the notch 142 is in alignment with the sensor assembly, and provides a low level signal otherwise.

Figure 5:
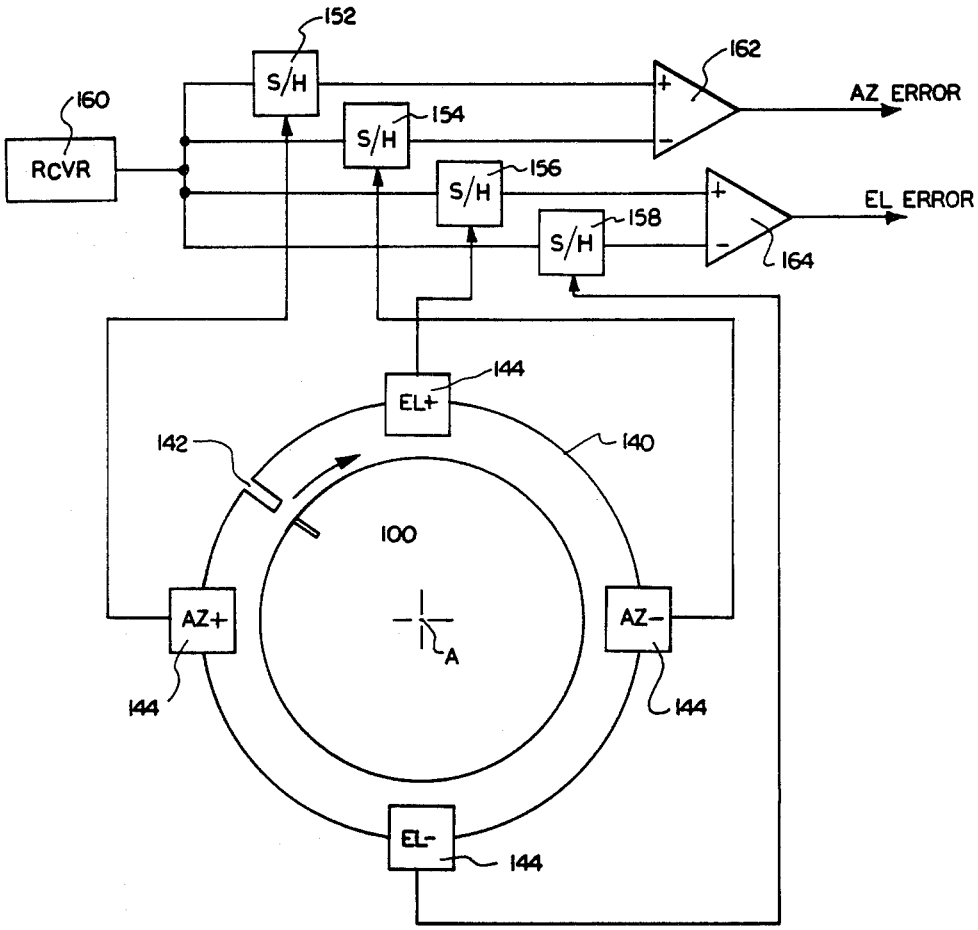
FIG. 5 is a block diagram of a circuit for demodulating the signal received by the tracking feed shown in the other figures.

FIG. 5 is a schematic representation of the physical structure and circuitry utilized to derive azimuthal and elevational error signals from the modulated signal provided by the tracking feed of FIG. 4. The circuit includes a demodulator 160 which detects the envelope of the signal provided by the receiver/transmitter 22 (FIG. 2). The demodulator output signal has an amplitude which is proportional to the amplitude of the received signal. When the signal source is located off the boresight of the antenna, the amplitude varies in a cyclical manner in accordance with rotation of the phase center of the antenna, which in turn is directly related to the rotation of the intermediate cylindrical waveguide portion 116 to which the ring 140 is attached.

The amplitude of the received signal is measured four times in each revolution of the cylindrical waveguide portion 116; once each time one of the four sensor assemblies provides a high output signal. To this end, the output of the demodulator 160 is applied to four sample and hold circuits 152, 154, 156 and 158. Each of the sample and hold circuits is controlled by the output of a corresponding one of the four optical sensor assemblies such that it samples the applied input signal when the output of the corresponding sensor assembly is high. Each sample and hold circuit holds the sampled value when the corresponding sensor output is low.

Sample and hold circuits 152 and 154 are triggered by pulses provided by the sensor assemblies identified in FIG. 5 as the AZ+ and AZ− assemblies. The output signals provided by the sample and hold circuits 152 and 154 thus represent the amplitudes of the received signal at the instances in the time when the phase center of the feed in on opposite sides of the axis A. A differencing amplifier 162 subtracts the output signals provided by the sample and hold circuits 152 and 154 from one another to thereby derive a signal corresponding to tracking error in the plane defined by the axis A and the line joining the AZ+ and AZ− sensor assemblies.

Similarly, the sample and hold circuits 156 and 158 are triggered by pulses provided by the other two sensor assemblies, identified in FIG. 5 as the EL+ and EL− sensor assemblies. The output signals provided by the sample and hold circuits 156 and 158 are subtracted from one another by a differencing amplifier 164 to derive a tracking error signal indicative of tracking error in a plane defined by the axis A and the line joining the EL+ and EL− sensor assemblies.

The output signals provided by the differencing amplifiers 162 and 164 are directed to appropriate servo mechanisms (not shown) for repositioning the directional antenna so as to reduce the tracking error signals. This will occur when the target is more nearly aligned with the boresight axis A of the tracking feed.

Although the invention has been described with respect to a preferred embodiment, it will be appreciated that various rearrangements and alterations of parts may be made without departing from the spirit and scope of the present invention, as defined in the appended claims.

What is claimed is:

1. An apparatus comprising:

a horn antenna having a phase center, at least one electrically conductive metallic rod-like element located adjacent a wall of said horn antenna at an axial position near said phase center, and means coupled to said element for rotating said element around said phase center so as to thereby cause the phase center of said horn antenna to also rotate.

2. Apparatus as set forth in claim 1, wherein said horn antenna includes a flared section having a mouth and a throat and a waveguide section coupled to the throat of said flared section, said horn antenna being designed such that said phase center is located near the throat of said flared section, and further wherein said rod-like elements are located adjacent a wall of said antenna near said throat of said flared section.

3. Apparatus as set forth in claim 2, wherein said flared section is corrugated.

4. An apparatus comprising:

a horn antenna having a phase center, at least one rod-like element located adjacent a wall of said horn antenna at an axial position near said phase center, means coupled to said element for rotating said element around said phase center so as to thereby cause the phase center of said horn antenna to also rotate, and said horn antenna includes a flared section having a mouth and a throat and a waveguide section coupled to the throat of said flared section, said horn antenna being designed such that said phase center is located near the throat of said flared section, and further wherein said rod-like elements are located adjacent a wall of said antenna near said throat of said flared section, said flared section is corrugated, and said at least one rod-like element extends radially inward from an interior wall of said horn antenna near the throat of said flared section.

5. Apparatus as set forth in claim 4, wherein said at least one rod-like element has a length on the order of one-eighth of a wavelength at the mean operating frequency of said antenna.

6. An apparatus comprising:

a horn antenna having a phase center, at least one rod-like element located adjacent a wall of said horn antenna at an axial position near said phase center, means coupled to said element for rotating said element around said phase center so as to thereby cause the phase center of said horn antenna to also rotate, and said at least one rod-like element extends radially inward from an interior wall of said horn antenna.

7. Apparatus as set forth in claim 6, wherein said at least one rod-like element is disposed substantially normal to the interior horn antenna wall from which it protrudes.

8. Apparatus as set forth in claim 6, wherein said at least one rod-like element is electrically shorted to said interior wall of said horn antenna.

9. Apparatus as set forth in claim 6, wherein said at least one rod-like element has a length on the order of one-eighth of a wavelength at the means operating frequency of said antenna.

10. An apparatus comprising:

a horn antenna having a phase center, at least one rod-like element located adjacent a wall of said horn antenna at an axial position near said phase center, means coupled to said element for rotating said element around said phase center so as to thereby cause the phase center of said horn antenna to also rotate, and there are at least two different sets of said rod-like elements at different axial locations along said horn antenna, each set including at least one rod-like element.

11. Apparatus as set forth in claim 10, wherein the rod-like elements of one of said sets of elements are dimensioned and positioned so as to maximize the modulation imparted to a received signal by said rotating phase center.

12. Apparatus as set forth in claim 10, wherein a first set of rod-like elements comprises a first rod-like element protruding from said wall of said horn antenna near said phase center, and wherein a second set of rod-like elements comprises at least second and third rod-like elements protruding from said wall of said horn antenna at a different axial location than said first element, said second and third elements also being circumferentially offset from said first element by equal and opposite amounts.

13. Apparatus as set forth in claim 12, wherein said second and third rod-like elements are dimensioned and positioned so as to maximize the modulation imparted to a received signal by said rotating phase center.

14. Apparatus comprising:

a reflector having a focal point, a horn antenna located at said focal point and having an amplitude pattern directed toward said reflector, at least one linear electrically conductive metallic element disposed adjacent a wall of said horn antenna near its mouth, said element having a length and location selected to shift the phase center of said antenna from the antenna's normal position but not to affect the direction of its radiaion pattern, and means for rotating said element around the interior of said waveguide so as to rotate the phase center of said waveguide, thereby causing conical scanning of the secondary pattern produced by said reflector.

* * * * *